US006327754B1

(12) United States Patent
Belmont et al.

(10) Patent No.: US 6,327,754 B1
(45) Date of Patent: Dec. 11, 2001

(54) FASTENER WITH SLIDER THEREON FOR USE IN MANUFACTURING RECLOSEABLE BAGS

(75) Inventors: Kirk E. Belmont, Fairport; Ian J. Barclay, Marion, both of NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/307,843

(22) Filed: May 10, 1999

(51) Int. Cl.[7] ..... A44B 19/16; B65D 33/16

(52) U.S. Cl. ..... 24/400; 24/389; 24/399; 24/587; 383/63

(58) Field of Search ..... 24/399, 400, 387, 24/587, 389, 402; 383/5, 63

(56) References Cited

U.S. PATENT DOCUMENTS

| | | | |
|---|---|---|---|
| Re. 27,174 | 9/1971 | Ausnit | 150/3 |
| Re. 31,487 | 1/1984 | Friedberg | 24/386 |
| Re. 34,554 | 3/1994 | Ausnit | 383/63 |
| Re. 34,905 | 4/1995 | Ausnit | 53/412 |
| Re. 34,906 | 4/1995 | Tamaki et al. | 123/399 |
| 1,785,234 | 12/1930 | Sundback . | |
| 2,091,617 | 8/1937 | Sunback | 18/59 |
| 3,149,927 | 9/1964 | Fady | 29/180 |
| 3,225,429 | 12/1965 | Fady | 29/408 |
| 3,259,951 | 7/1966 | Zimmerman | 24/201 |
| 3,381,592 | 5/1968 | Ravel | 93/8 |
| 3,426,396 | 2/1969 | Laguerre | 24/201 |
| 3,473,589 | 10/1969 | Götz | 150/3 |
| 3,532,571 | 10/1970 | Ausnit | 156/91 |
| 3,608,439 | 9/1971 | Ausnit | 93/35 R |
| 3,613,524 | 10/1971 | Behr et al. | 93/33 R |
| 3,701,191 | 10/1972 | Laguerre | 29/207.5 SL |
| 3,701,192 | 10/1972 | Laguerre | 29/207.5 SL |
| 3,785,111 | 1/1974 | Pike | 53/14 |
| 3,790,992 | 2/1974 | Herz | 24/201 C |
| 3,839,128 | 10/1974 | Arai | 156/583 |
| 3,849,843 | 11/1974 | Alberts | 24/205 |
| 3,868,891 | 3/1975 | Parish | 93/8 W |
| 3,948,705 | 4/1976 | Ausnit | 156/73.4 |
| 3,962,007 | 6/1976 | Takeshima et al | 24/408 |
| 4,094,729 | 6/1978 | Boccia | 156/515 |
| 4,101,355 | 7/1978 | Ausnit | 156/66 |
| 4,196,030 | 4/1980 | Ausnit | 156/91 |
| 4,232,429 | 11/1980 | Friedberg | 24/205.11 R |
| 4,240,241 | 12/1980 | Sanborn, Jr. | 53/412 |
| 4,277,241 | 7/1981 | Schulze | 493/196 |
| 4,341,575 | 7/1982 | Herz | 156/66 |
| 4,355,494 | 10/1982 | Tilman | 53/416 |
| 4,372,793 | 2/1983 | Herz | 156/66 |
| 4,395,891 * | 8/1983 | Remington | 70/68 |

(List continued on next page.)

FOREIGN PATENT DOCUMENTS

| | | | |
|---|---|---|---|
| 0 978 450 A1 | 2/2000 | (EP) . | |
| 1564039 | 3/1969 | (FR) . | |
| 0522663 | 6/1940 | (GB) . | |
| 2085519 | 4/1982 | (GB) | A44B/19/62 |
| 2 138 494 | 10/1984 | (GB) . | |
| WO 99/24325 | 5/1999 | (WO) | B65B/61/18 |

*Primary Examiner*—Victor N. Sakran
(74) *Attorney, Agent, or Firm*—Jenkens & Gilchrist

(57) ABSTRACT

A plurality of fastener arrangements for use in manufacturing recloseable bags comprising a first fastener and a second fastener connected to the first fastener. Each of said fasteners comprising a male track with a male profile, a female track with a female profile and a slider. The male and female profiles are releasably engageable to each other. The slider is slidably mounted to the fastener for movement between a closed position and an open position. The male and female profiles are engaged to each other while the slider is in the closed position. The male and female profiles are disengaged from each other in response to movement of the slider from the closed position to the open position.

20 Claims, 6 Drawing Sheets

U.S. PATENT DOCUMENTS

| | | | |
|---|---|---|---|
| 4,415,386 | 11/1983 | Ferrell et al. | 156/64 |
| 4,430,070 | 2/1984 | Ausnit | 493/215 |
| 4,437,293 | 3/1984 | Sanborn, Jr. | 53/412 |
| 4,446,088 | 5/1984 | Daines | 264/155 |
| 4,517,788 | 5/1985 | Scheffers | 53/459 |
| 4,528,224 | 7/1985 | Ausnit | 428/36 |
| 4,563,319 | 1/1986 | Ausnit et al. | 264/146 |
| 4,581,006 | 4/1986 | Hugues et al. | 493/213 |
| 4,582,549 | 4/1986 | Ferrell | 156/66 |
| 4,601,694 | 7/1986 | Ausnit | 493/381 |
| 4,612,153 | 9/1986 | Mangla | 264/154 |
| 4,617,683 | 10/1986 | Christoff | 383/63 |
| 4,620,320 | 10/1986 | Sullivan | 383/79 |
| 4,651,504 | 3/1987 | Bentsen | 53/452 |
| 4,652,496 | 3/1987 | Yasufuku et al. | 428/425.9 |
| 4,655,862 | 4/1987 | Christoff et al. | 156/66 |
| 4,663,915 | 5/1987 | Van Erden et al. | 53/450 |
| 4,666,536 | 5/1987 | Van Erden et al. | 156/64 |
| 4,673,383 | 6/1987 | Bentsen | 493/381 |
| 4,691,372 | 9/1987 | Van Erden | 383/63 |
| 4,703,518 | 10/1987 | Ausnit | 383/63 |
| 4,709,398 | 11/1987 | Ausnit | 383/63 |
| 4,709,533 | 12/1987 | Ausnit | 53/451 |
| 4,710,157 | 12/1987 | Posey | 493/213 |
| 4,782,951 | 11/1988 | Griesbach et al. | 206/484 |
| 4,786,190 | 11/1988 | Van Erden et al. | 383/61 |
| 4,787,880 | 11/1988 | Ausnit | 493/213 |
| 4,790,126 | 12/1988 | Boeckmann | 53/451 |
| 4,792,240 | 12/1988 | Ausnit | 383/63 |
| 4,807,300 | 2/1989 | Ausnit et al. | 383/65 |
| 4,812,074 | 3/1989 | Ausnit et al. | 493/213 |
| 4,832,505 | 5/1989 | Ausnit et al. | 383/5 |
| 4,840,012 | 6/1989 | Boeckmann | 53/410 |
| 4,840,611 | 6/1989 | Van Erden et al. | 493/213 |
| 4,844,759 | 7/1989 | Boeckmann | 156/66 |
| 4,850,178 | 7/1989 | Ausnit | 53/570 |
| 4,863,285 | 9/1989 | Claxton | 383/37 |
| 4,876,842 | 10/1989 | Ausnit | 53/410 |
| 4,878,987 | 11/1989 | Ven Erden | 156/519 |
| 4,892,414 | 1/1990 | Ausnit | 383/63 |
| 4,892,512 | 1/1990 | Branson | 493/194 |
| 4,894,975 | 1/1990 | Ausnit | 53/412 |
| 4,909,017 | 3/1990 | McMahon et al. | 53/410 |
| 4,924,655 | 5/1990 | Posey | 53/128 |
| 4,925,316 | 5/1990 | Van Erden et al. | 383/61 |
| 4,925,318 | 5/1990 | Sorensen | 383/63 |
| 4,929,225 | 5/1990 | Ausnit et al. | 493/213 |
| 4,941,307 | 7/1990 | Wojcik | 53/412 |
| 4,969,309 | 11/1990 | Schwarz et al. | 53/412 |
| 4,971,454 | 11/1990 | Branson et al. | 383/61 |
| 4,974,395 | 12/1990 | McMahon | 53/551 |
| 4,993,212 | 2/1991 | Veoukas | 53/451 |
| 5,005,707 | 4/1991 | Hustad et al. | 206/632 |
| 5,010,627 | 4/1991 | Herrington et al. | 24/400 |
| 5,014,498 | 5/1991 | McMahon | 53/451 |
| 5,024,537 | 6/1991 | Tilman | 383/63 |
| 5,027,584 | 7/1991 | McMahon et al. | 53/451 |
| 5,036,643 | 8/1991 | Bodolay | 53/128.1 |
| 5,042,224 | 8/1991 | McMahon | 53/133.4 |
| 5,046,300 | 9/1991 | Custer et al. | 53/412 |
| 5,063,639 | 11/1991 | Boeckmann et al. | 24/30.5 R |
| 5,063,644 | 11/1991 | Herrington et al. | 24/400 |
| 5,067,208 | 11/1991 | Herrington, Jr. et al. | 24/400 |
| 5,067,822 | 11/1991 | Wirth et al. | 383/61 |
| 5,071,689 | 12/1991 | Tilman | 428/121 |
| 5,072,571 | 12/1991 | Boeckmann | 53/133.4 |
| 5,085,031 | 2/1992 | McDonald | 53/412 |
| 5,088,971 | 2/1992 | Herrington | 493/203 |
| 5,092,831 | 3/1992 | James et al. | 493/394 |
| 5,096,516 | 3/1992 | McDonald et al. | 156/66 |
| 5,105,603 | 4/1992 | Natterer | 53/412 |
| 5,107,658 | 4/1992 | Hustad et al. | 53/408 |
| 5,111,643 | 5/1992 | Hobock | 53/551 |
| 5,116,301 | 5/1992 | Robinson et al. | 493/215 |
| 5,127,208 | 7/1992 | Custer et al. | 53/412 |
| 5,131,121 | 7/1992 | Herrington, Jr. et al. | 24/436 |
| 5,147,272 | 9/1992 | Richison et al. | 493/195 |
| 5,161,286 | 11/1992 | Herrington, Jr. et al. | 24/387 |
| 5,167,608 | 12/1992 | Steffens, Jr. et al. | 493/214 |
| 5,179,816 | 1/1993 | Wojnicki | 53/133.4 |
| 5,188,461 | 2/1993 | Sorensen | 383/63 |
| 5,198,055 | 3/1993 | Wirth et al. | 156/66 |
| 5,211,482 | 5/1993 | Tilman | 383/202 |
| 5,247,781 | 9/1993 | Runge | 53/412 |
| 5,254,073 | 10/1993 | Richison et al. | 493/195 |
| 5,259,904 | 11/1993 | Ausnit | 156/244.15 |
| 5,273,511 | 12/1993 | Boeckman | 493/195 |
| 5,322,579 | 6/1994 | Van Erden | 156/66 |
| 5,334,127 | 8/1994 | Bruno et al. | 493/194 |
| 5,383,989 | 1/1995 | McMahon | 156/66 |
| 5,391,136 | 2/1995 | Makowka | 493/210 |
| 5,400,565 | 3/1995 | Terminella et al. | 53/133.4 |
| 5,400,568 | 3/1995 | Kanemitsu et al. | 53/412 |
| 5,403,094 | 4/1995 | Tomic | 383/63 |
| 5,405,478 | 4/1995 | Richardson et al. | 156/308.4 |
| 5,405,629 | 4/1995 | Marnocha et al. | 426/122 |
| 5,412,924 | 5/1995 | Ausnit | 53/412 |
| 5,415,904 | 5/1995 | Takubo et al. | 428/35.2 |
| 5,425,216 | 6/1995 | Ausnit | 53/410 |
| 5,425,825 | 6/1995 | Rasko et al. | 156/66 |
| 5,431,760 | 7/1995 | Donovan | 156/66 |
| 5,435,864 | 7/1995 | Machacek et al. | 156/66 |
| 5,442,837 | 8/1995 | Morgan | 24/400 |
| 5,442,838 | 8/1995 | Richardson et al. | 24/402 |
| 5,448,807 | 9/1995 | Herrington, Jr. | 24/399 |
| 5,456,928 | 10/1995 | Hustad et al. | 426/87 |
| 5,461,845 | 10/1995 | Yeager | 53/451 |
| 5,470,156 | 11/1995 | May | 383/210 |
| 5,482,375 | 1/1996 | Richardson et al. | 383/64 |
| 5,486,051 | 1/1996 | May | 383/200 |
| 5,489,252 | 2/1996 | May | 383/210 |
| 5,492,411 | 2/1996 | May | 383/5 |
| 5,505,037 | 4/1996 | Terminella et al. | 53/133.4 |
| 5,509,735 | 4/1996 | May | 383/210 |
| 5,511,884 | 4/1996 | Bruno et al. | 383/63 |
| 5,513,915 | 5/1996 | May | 383/210 |
| 5,519,982 | 5/1996 | Herber et al. | 53/412 |
| 5,525,363 | 6/1996 | Herber et al. | 426/130 |
| 5,542,902 | 8/1996 | Richison et al. | 493/195 |
| 5,551,127 | 9/1996 | May | 24/30.5 R |
| 5,551,208 | 9/1996 | Van Erden | 53/139.2 |
| 5,552,202 | 9/1996 | May | 428/43 |
| 5,557,907 | 9/1996 | Malin et al. | 53/139.2 |
| 5,558,613 | 9/1996 | Tilman et al. | 493/214 |
| 5,561,966 | 10/1996 | English | 53/412 |
| 5,564,259 | 10/1996 | Stolmeier | 53/410 |
| 5,573,614 | 11/1996 | Tilman et al. | 156/66 |
| 5,582,853 | 12/1996 | Marnocha et al. | 426/122 |
| 5,592,802 | 1/1997 | Malin et al. | 53/133.4 |
| 5,613,934 | 3/1997 | May | 493/214 |
| 5,622,431 | 4/1997 | Simonsen | 383/63 |
| 5,628,566 | 5/1997 | Schreiter | 383/63 |
| 5,647,671 | 7/1997 | May | 383/210 |
| 5,664,296 | 9/1997 | May | 24/30.5 R |
| 5,669,715 * | 9/1997 | Dobreski et al. | 383/5 |
| 5,682,730 | 11/1997 | Dobreski | 53/469 |
| 5,711,751 | 1/1998 | Harmanoglu | 493/224 |
| 5,713,110 | 2/1998 | Covi et al. | 24/431 |
| 5,713,669 | 2/1998 | Thomas et al. | 383/204 |
| 5,725,312 | 3/1998 | May | 383/210 |
| 5,782,733 | 7/1998 | Yeager | 493/213 |

| | | | | |
|---|---|---|---|---|
| 5,823,933 | | 10/1998 | Yeager | 493/213 |
| 5,833,791 | | 11/1998 | Bryniarski et al. | 156/244.25 |
| 5,851,070 | | 12/1998 | Dobreski et al. | 383/63 |
| 5,896,627 | | 4/1999 | Cappel et al. | 24/400 |
| 5,906,438 | | 5/1999 | Laudenberg | 383/63 |
| 5,924,173 | | 7/1999 | Dobreski et al. | 24/400 |
| 5,938,337 | * | 8/1999 | Provan et al. | 383/5 |
| 5,953,796 | | 9/1999 | McMahon et al. | 24/400 |
| 5,956,815 | | 9/1999 | O'Connor et al. | 24/30.5 |
| 5,956,924 | | 9/1999 | Thieman | 53/412 |
| 6,138,436 | | 10/2000 | Malin et al. . | |
| 6,138,439 | | 10/2000 | McMahon et al. . | |
| 6,178,722 | | 1/2001 | McMahon | 53/412 |

* cited by examiner

FASTENER WITH SLIDER THEREON FOR USE IN MANUFACTURING RECLOSEABLE BAGS

FIELD OF THE INVENTION

The present invention relates generally to the packaging industry. More particularly, the invention relates to a fastener with a slider for use in a recloseable package.

RELATED APPLICATIONS

This application is related to an application entitled "Assembly and Accumulation of Sliders for Profiled Zippers" Ser. No. 09/307,893 filed May 10, 1999; and to an application entitled "Zipper and Zipper Arrangements and Methods of Manufacturing the Same" 09/307,937 filed May 10, 1999. Both applications were filed concurrently with this application and are assigned to the same assignee as the assignee of this application. Both applications and their disclosures are incorporated herein in their entirety.

BACKGROUND OF THE INVENTION

Plastic packages are popular for storing food products and other items. Recloseable packages that can be securely closed and reopened are particularly popular due to their ability to maintain freshness of the food stored in the package and/or to minimize leakage into and out of the package. Thus, recloseable packages are very common, especially in the food industry. Recloseable packages are typically made to be recloseable via the use of a recloseable feature such as a resealable adhesive seal or a recloseable zipper. Recloseable zippers can be opened and closed either by pressure or by the use of an auxiliary slider mechanism. These packages are used one at a time by consumers and large numbers of these packages are also used by businesses to package items that are then sold to consumers. An example of a business that uses a large number of these packages is a food producer and packer. For example, nuts, candy, snacks, salt, cheese, other food and non-food products can be packed in these packages by form, fill and seal machines and sold to consumers.

For a variety of reasons, including difficulty in closing the zipper, some consumers prefer an easier way to open and close the zippers on these packages. As a result, zipper packages with the slider to open and close the zipper have become popular with consumers. Product manufacturers, however, have rarely used the zipper with slider in their form, fill and seal machines because there has not been a way to assemble and accumulate the zippers with sliders in a configuration that can be easily and quickly fed to the form, fill and seal machines. A need therefore exists for an efficient method and apparatus for providing products within a recloseable package. Additionally, a need exists for a fastener with slider thereon that can easily and efficiently be used in the manufacture of recloseable bags.

SUMMARY OF THE INVENTION

In one aspect of the present invention, there is provided a fastener arrangement for use in manufacturing recloseable bags. The fastener arrangement comprises a first fastener connected to a second fastener. Each of the fasteners comprise a male track with a male profile, a female track with a female profile and a slider. The male and female profiles are releasably engageable to each other. The slider is slidably mounted to the fastener for movement between a closed position and an open position. The male and female profiles are engaged to each other while the slider is in the closed position. The male and female profiles are disengaged from each other in response to movement of said slider from the closed position to the open position. The first fastener may be connected in line with the second fastener. Additionally, the first fastener may be connected to the second fastener such that the male and female tracks of the first fastener are substantially parallel to the male and female tracks of the second fastener.

In another aspect of the present invention, there is provided a sheet of zippers for use in manufacturing recloseable packages. The sheet of zippers comprises a first zipper releasably connected to a second zipper. The first zipper and the second zipper both have a male track with a male profile, a female track with female profile and a slider. The male and female profiles are releasably engageable to each other. The slider is slidably mounted to the zipper for movement between a closed position and an open position. The male and female profiles are engaged to each other while the slider is in the closed position. The male and female profiles are disengaged from each other in response to movement of the slider from the closed position to the open position. The first zipper and second zipper may have a length approximately equal to a length of the recloseable package. The first zipper is releasably adhered to the second zipper with a releasable adhesive or with a releasable seal. The first zipper may be connected to the second zipper such that the male and female tracks of the first zipper are substantially parallel to the male and female tracks of the second zipper. Each of the zippers may further comprise a first fin extending downward from the male profile and a second fin extending downward from the female profile. The first zipper may be connected to the second zipper by releasably adhering one of the fins of the first zipper to one of the profiles of the second zipper.

In a further aspect of the present invention, there is provided a zipper arrangement for use in manufacturing recloseable bags. The zipper arrangement comprises a male track with a male profile, a female track with a female profile and a plurality of sliders. The male and female profiles are releasably engageable to each other. The plurality of sliders are slidably mounted to the engageable male and female tracks for movement between a closed position and an open position. The male and female profiles are engaged to each other while the slider is in the closed position. The male and female profiles are disengaged from each other in response to movement of said slider from said closed position to said open position. One of the sliders is positioned in a length of the male and female track corresponding to a length of one of the recloseable bags.

In a further aspect of the present invention, there is provided a method of manufacturing recloseable packages. The method comprises providing a first wall panel opposing a second wall panel, positioning a zipper with a slider between the first and second wall panels, adhering a first profile of the zipper to the first wall panel, forming a first and a second side seal in the web to define a first and a second sidewall of the package, adhering the second profile of the zipper to the second wall panel at the mouth, and cutting the side seal to separate adjacent packages. The method may further include feeding a zipper arrangement between the wall panels before positioning the zipper. The zipper arrangement comprises a continuous male track and a continuous female track with a plurality of sliders. Alternatively, the method may further include feeding a sheet of zippers with sliders between the wall panels before positioning the zipper. The sheet of zippers comprises a plurality of zippers releasably adhered to each other. The method may further include filling the package with a product.

BRIEF DESCRIPTION OF THE DRAWINGS

Other objects and advantages of the invention will become apparent upon reading the following detailed description and upon reference to the drawings which.

While the invention will be described in connection with certain preferred embodiments, it is not intended to limit the invention to the specific exemplary embodiments. On the contrary, it is intended to cover all alternatives, modifications, and equivalents as may be included within the spirit and scope of the invention as defined by the appended claims.

DESCRIPTION OF ILLUSTRATIVE EMBODIMENTS

Figure 1:
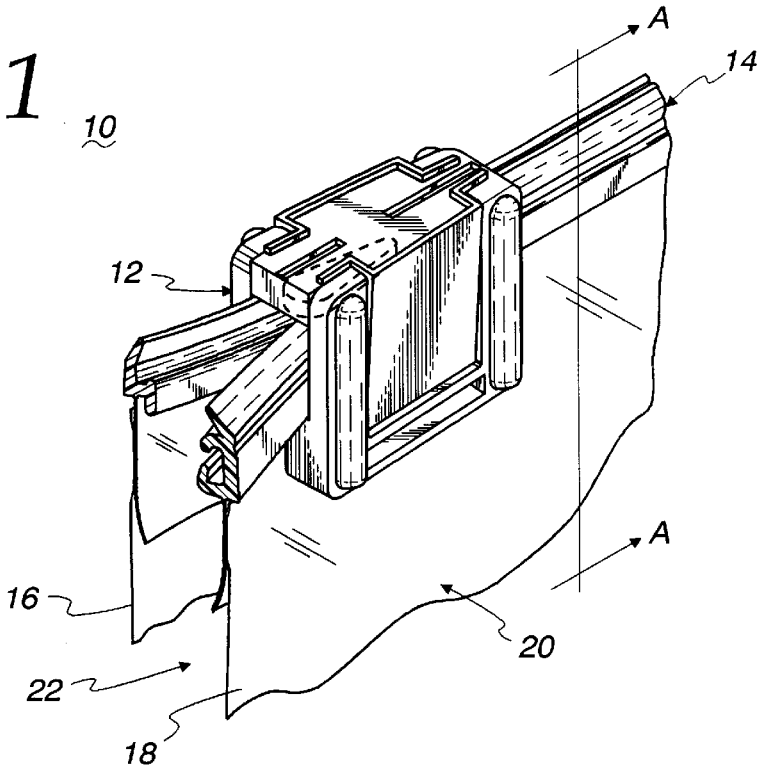
FIG. 1 is a perspective view of a fastener with a slider for a recloseable bag.
Figure 2:
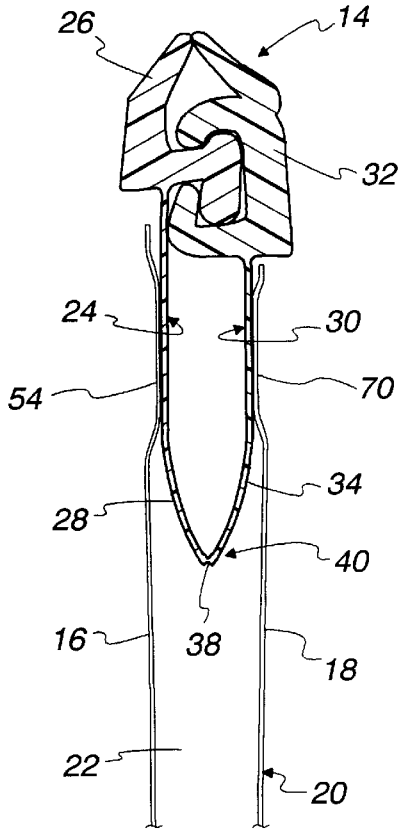
FIG. 2 is a cross section of the fastener of FIG. 1.

Turning now to the drawings, FIG. 1 illustrates a mouth portion of a recloseable package 10 having a slider 12 on a fastener or zipper arrangement 14. FIG. 2 illustrates the fastener or zipper arrangement 14 of the mouth portion of the recloseable bag along line A—A. The mouth portion of the recloseable package 10 includes a pair of opposing wall panels 16 and 18 which make up a package body 20 and define a receptacle space 22. The wall panels 16 and 18 may comprise polymeric film, multilayer and multi-component laminations or coextrusions. Connected to the wall panel 16 is a male track 24 having a male profile 26 and a first fin portion 28 extending downward from the male profile 26. Connected to the other wall panel 18 is a female track 30 having a female profile 32 and a second fin portion 34 extending downward from the female profile 32. The male and female profiles 26 and 32 are releasably engageable with each other to provide a recloseable seal to the package.

In the illustrated embodiment of FIG. 2, the lower edges of the first and second fin portions 28 and 34 are joined to each other along a one-time breakable preferential area of weakness or preferential tear area 38 to for a one-time openable tamper evident feature 40. The joined first and second fin portions 28 and 34 have a generally U-shaped or V-shaped cross-sectional configuration. The tamper evident feature 40 is described in detail in Ser. No. 08/694,093 to Thomas et al., which is incorporated herein by reference in its entirety. Other embodiments of the fastener 14 may not include the tamper evident feature leaving the fin portions 28 and 34 disconnected.

The recloseable package 10 has the slider 12 (see FIG. 1) slidably mounted to the fastener 14 for movement between a closed position and an open position. The male and female profiles 26 and 32 are engaged to each other while the slider 12 is in the closed position, and movement of the slider 12 from the closed position to the open position disengages the profiles 26 and 32 from each other (see FIG. 2). FIG. 1 depicts the open position to the left of the slider 12 and the closed position to the right of the slider 12. The composition and manner of operation of the fastener with slider arrangement is described in detail in U.S. Pat. No. 5,067,208 to Herrington, Jr. et. al., which is incorporated herein by reference in its entirety.

Figures 3A, 4:
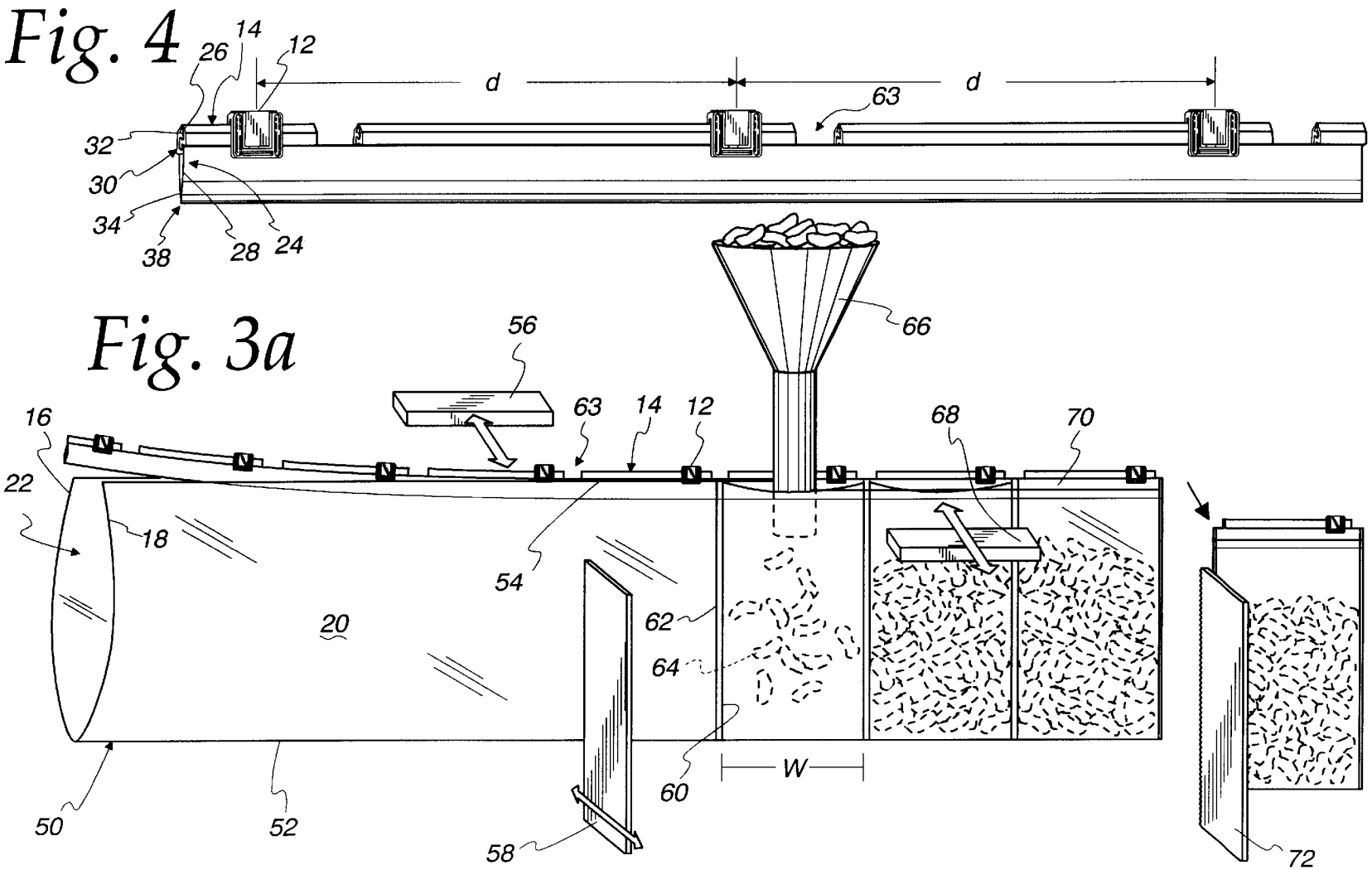
FIG. 3*a* is a process diagram of a form, fill and seal process.
FIG. 4 is a perspective view of a zipper arrangement.

FIG. 3*a* illustrates one embodiment of a form, fill and seal process for providing a product within a recloseable package having the fastener 14 with slider 12. The process folds a web of packaging material 50, such as polymeric film, multilayer and multi-component laminations or coextrusions consisting of polymer, paper, metalized polymer or foil in any combination. The folded web 50 forms the package body 20 and defines the receptacle space 22 bounded by the opposing wall panels 16 and 18 and a package bottom 52. The process also positions the fastener 14 with the slidably mounted slider 12 at the mouth of the recloseable package between the opposing wall panels 16 and 18. The fastener 14 with slider 12 is preferably in the closed position when fed to the form, fill and seal apparatus. As depicted in FIG. 3*a*, a top seal bar 56 moves back and forth to adhere the wall panel 16 to the male track 24 forming a first top seal 54. The first top seal 54 between the wall panel 16 and male track 24 is also depicted in FIG. 2. The fastener 14 may be adhered to one of the wall panels of the web 50 by heat seal, adhesive or any other appropriate method to form a strong preferably hermetic first top seal 54 (some recloseable packages require vents for air removal).

After the fastener 14 with slider 12 is attached to the wall panel 16, a vertical seal bar 58 joins the wall panels 16 and 18 together to form a side seal 60 that defines a side wall 62 of the recloseable package. The distance between adjacent side seals 60 should be approximately equal to the desired width W of the recloseable package. The side seal 60 may be formed by heat seal, adhesive or any other appropriate method to form a strong preferably hermetic seal. In the embodiment depicted, the side seal 60 is preferably formed at the notch 63 in the zipper arrangement 14 which allows easier side sealing since the vertical seal bar 58 does not have to flatten or crush the profiles 26 and 32 of the fastener 14 in order to side seal the web 50. The notch 63 will be described below. Once the sidewalls 62 of the package are defined by the side seal 60, a product 64 fills the receptacle space 22 of the package. For illustration, FIG. 3*a* shows a funnel 66 directing the product 64, into the package. The product 64 may be nuts, candy, snacks, salt, cheese and other food and non-food products.

After the product 64 fills the package, a second top seal bar 68 adheres the fastener 14 to the other wall panel 18 preferably hermetically sealing the product 64 within the package. The second top seal bar 68 moves back and forth to provide a second top seal 70 that adheres the female track 30 to the wall panel 18. The second top seal 70 between the wall panel 18 and female track 30 is also depicted in FIG. 2. The fastener 14 may be adhered to the wall panels of the web 50 by heat seal, adhesive or any other appropriate method to form a strong preferably hermetic second top seal 70. To divide the adjacent packages of product 64 that are connected by the side seal 60, a knife 72 cuts the side seal 60 such that the side walls 60 of each package remain secure.

An end termination or stop (not shown) may be added to the ends of the fastener 14 for inhibiting or preventing the slider 16 from going past the ends of the zipper. The end terminations also hold the male and female profiles together to resist stresses applied to the profiles during normal use of the plastic bag. One type of end termination is in the form of a strap/clip that wraps over a top of a zipper. Further information concerning such an end termination may be found in U.S. Pat. No. 5,067,208, which is incorporated herein by reference in its entirety. One end of the strap is provided with a rivet-like member that penetrates through the zipper fins and into a cooperating opening at the other end of the strap. Other types of end termination are disclosed in U.S. Pat. Nos. 5,482,375, 5,448,807, 5,442,837, 5,405,478, 5,161,286, 5,131,121 and 5,088,971, which are each incorporated herein by reference in their entireties.

The form, fill and seal process may vary from the illustration of FIG. 3*a* and the following describes some of the possible variations. In another embodiment of the form, fill and seal process, the side seal 60 may be cut before filling the package with the product 64. In this embodiment, the process folds the web 50 and positions and top seals the fastener 14 to one of the wall panels 16. Next, the process forms and cuts the side seals 60. After the knife 72 cuts the side seals 60, the product 64 fills the package and the second top seal 70 closes the package. In another embodiment of the form, fill and seal process, the fastener may be sealed to one of the wall panels 16 prior to the folding of the web 50.

Figure 3B:
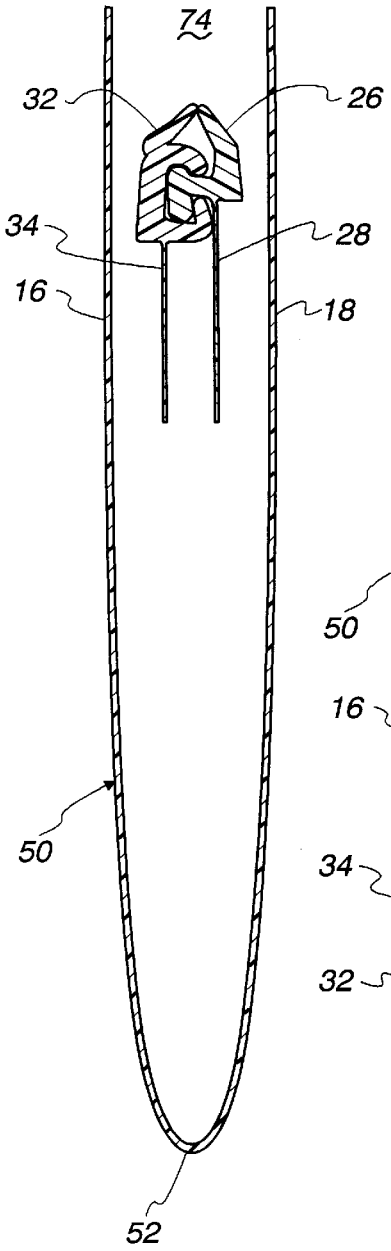
FIG. 3*b* is a cross section of another embodiment of the fastener position for the form, fill and seal process of FIG. 3*a;*

Other embodiments of the form, fill and seal process position the fastener 14 in different locations than the mouth of the web 50. FIG. 3*b* depicts the fastener 14 position prior to being attached to one of the wall panels 16 and 18. The fastener 14 is positioned below the mouth 74 of the web 50. In this embodiment, the recloseable package may be formed using the steps described above. Additionally in the embodiment of FIG. 3*b*, the fin portions 28 and 34 are not connected to provide the tamper evident feature. For the embodiment of FIG. 3*b*, the tamper evident feature may be provided by sealing the wall panels 16 and 18 together above the fastener 14 at the mouth 74.

Figure 3C:
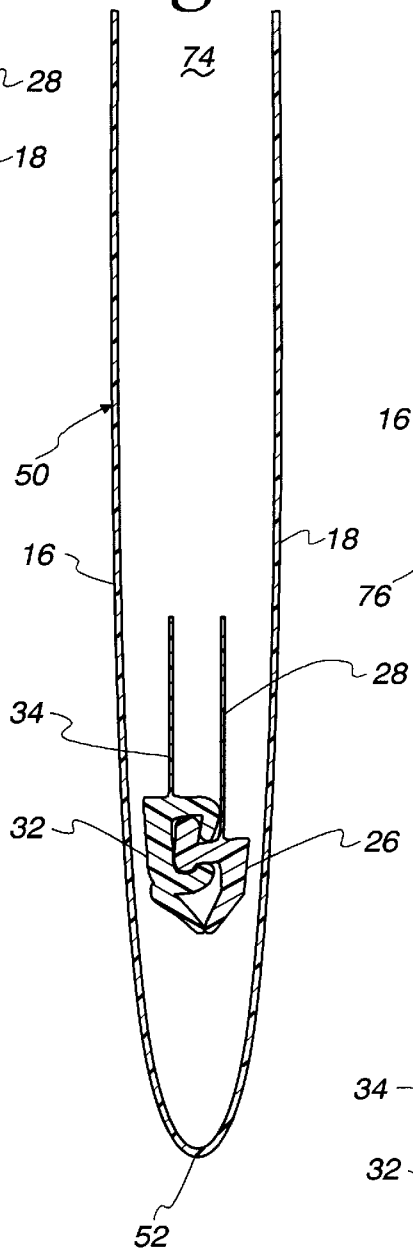
FIG. 3*c* is a cross section of another embodiment of the fastener position for the form, fill and seal process of FIG. 3*a;*

FIG. 3*c* illustrates another alternate position for the fastener 14 adjacent the bottom 52 of the web 50. The fastener 14 has an inverted orientation compared to the orientation of the fastener in FIGS. 3*a–b*. More specifically, the male and female profiles are adjacent to the bottom 52 of the package with the fins extending into the body of the package. For this embodiment, the fastener 14 should be sealed to both wall panels 16 and 18 before filling the package with the product 64. For example, the process folds the web 50 and positions the fastener 14 at the bottom 52 of the web 50 and seals the fastener 14 to both of the wall panels 16 and 18. Next, the process forms and cuts the side seals 60, and the product 64 fills the package. Finally, the process seals the wall panels 16 and 18 together at the mouth 74. Alternatively, the process fills the package with the product prior to cutting the side seals 60.

Figure 3D:
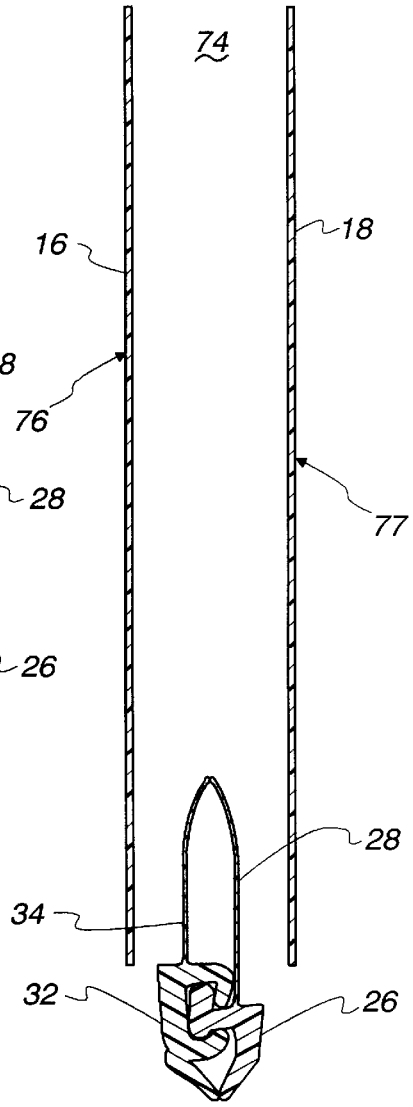
FIG. 3*d* is a cross section of another embodiment of the fastener position for the form, fill and seal process of FIG. 3*a;*

FIG. 3*d* illustrates another alternate position for the fastener 14 and embodiment for the form, fill and seal process. In this embodiment, a pair of separate webs 76 and 77 provide the wall panels 16 and 18. The process positions the fastener 14 with inverted orientation similar to FIG. 3*c* at the bottom of the wall panels 16 and 18 opposite the mouth 74 and seals the fastener 14 to both wall panels 16 and 18 before filling the package with the product 64. For example, the process provides a pair of webs 76 and 77 and seals the fastener 14 to both of the wall panels 16 and 18 at the bottom of the webs. Next, the process forms and cuts the side seals 60, and the product 64 fills the package. Finally, the process seals the wall panels 16 and 18 together at the mouth 74. Alternatively, the process fills the package with the product prior to cutting the side seals 60. In another embodiment of the form, fill and seal process, the fastener 14 may be sealed to one of the webs 76 prior to opposing the web 76 with the web 77.

Figure 5:
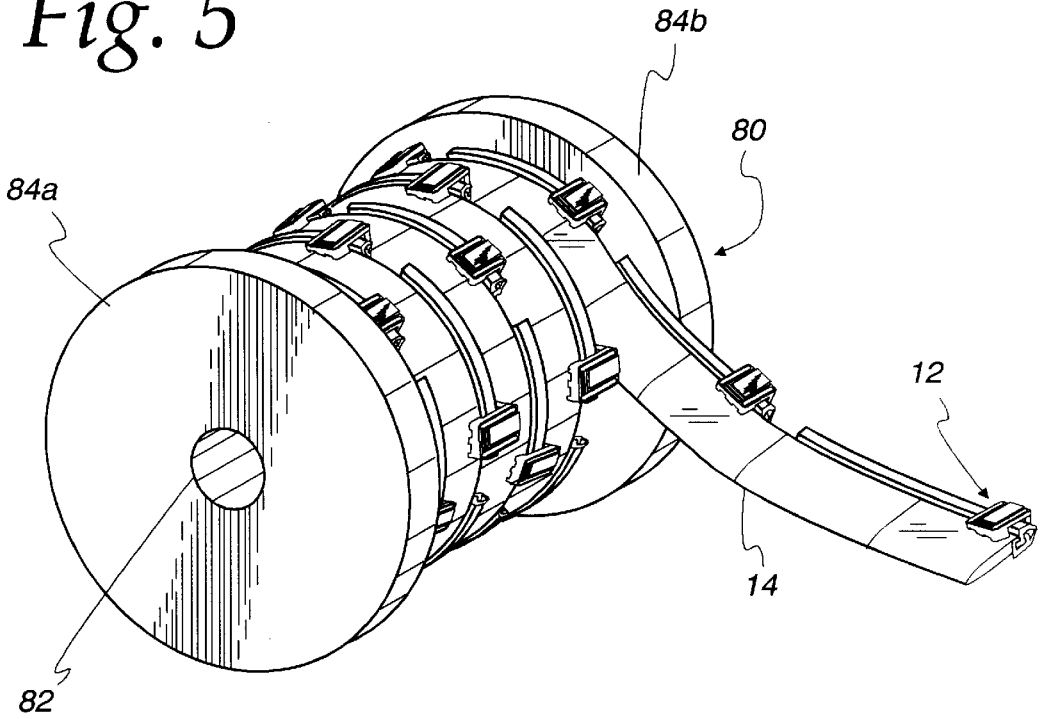
FIG. 5 is a roll of the zipper arrangement of FIG. 4.

In order to efficiently operate the form, fill and seal process described above in conjunction with FIGS. 3*a–d,* the fastener 14 with slider 12 should be readily fed to the form, fill and seal process. FIGS. 4–5 illustrate one embodiment for the supply of the fastener 14 with slider 12. FIG. 4 illustrates a zipper arrangement 14 with sliders 12 slidably mounted to the zipper 14 at predetermined distances d. The predetermined distance d is approximately equal to the distance between the center of the side seals 60 of the recloseable packages to insure that each package includes the slider 12. The zipper arrangement 14 comprises a continuous male track 24 having a discontinuous male profile 26 and a continuous first fin portion 28 and a continuous female track 30 having a discontinuous female profile 32 and a continuous second fin portion 34. In the embodiment depicted in FIG. 4, the first and second fin portions 28 and 34 are joined to each other along the one-time breakable preferential area of weakness 38 to provide the tamper evident feature. In another embodiment without the tamper evident feature, the first and second fin portions 28 and 34 are not joined to each other.

The zipper arrangement 14 may be formed by extruding the male track 24 and female track 30 together or separately and then joined. The sliders 12 are slidably mounted to the zipper 14 as described in detail in the patent application entitled "Zipper and Zipper Arrangements and Methods of Manufacturing the Same" Ser. No. 09/307,937 filed May 10, 1999 which is incorporated herein by reference in its entirety. In the embodiment illustrated in the figures, the male and female profiles of the fastener are notched 63 to allow the slider to slidably mount the fastener 14. This notching provides the discontinuous male and female profiles 26 and 32 shown in FIG. 4. The slider may be mounted onto the fastener by other means other than the embodiment illustrated in the figures. For embodiments that mount the slider without notching, the male and female profiles of FIG. 4 would be continuous.

The zipper arrangement 14 with sliders 12 at predetermined intervals may be accumulated onto a roll 80 as illustrated in FIG. 5. The roll 80 has a cylindrical core 82 around which the zipper arrangement 14 with sliders 12 is wrapped. The roll 80 may also include a pair of sidewalls 84*a* and 84*b* at the ends of the cylindrical core 82 to hold the windings of the zipper arrangement 14 on the roll 80. Alternatively, the zipper arrangement 14 may be rolled upon itself to form a cylinder. The sliders 12 may be advantageously positioned along the zipper arrangement 14 such that the roll 80 occupies a minimum amount of space. Preferably, the sliders 12 will be positioned to prevent adjacent layers of sliders from abutting or laying on top of each other.

Figure 6:
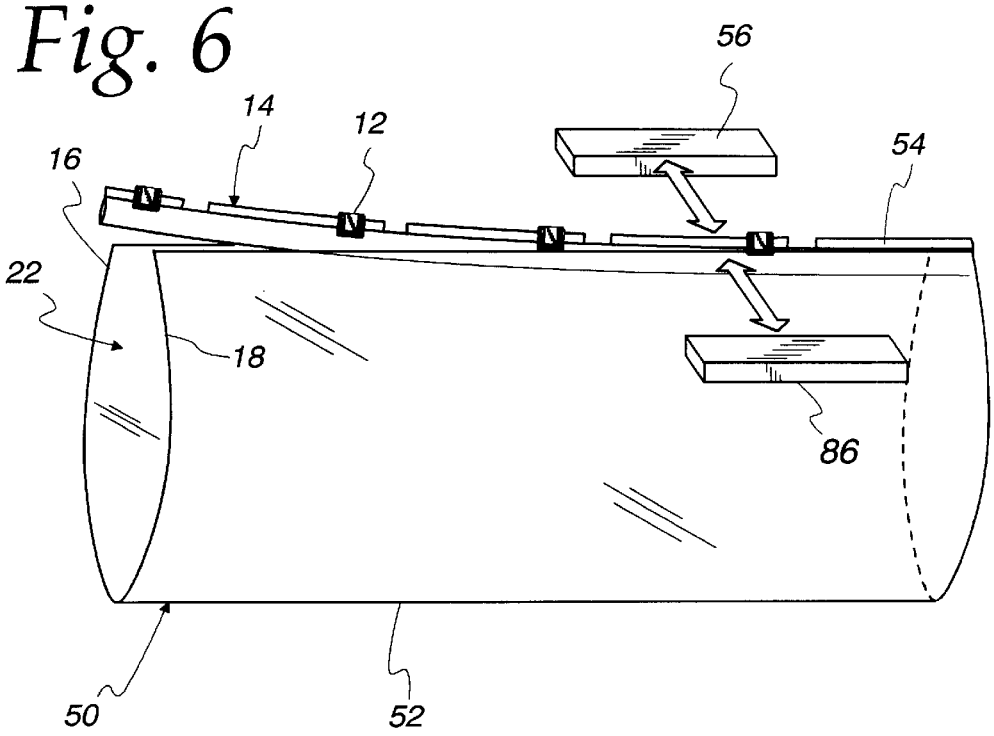
FIG. 6 is a process diagram of zipper arrangement of FIG. 4 fed to the form, fill and seal process.

The roll 80 of the zipper arrangement 14 with sliders 12 is particularly useful for supplying the fastener or zipper 14 with slider 12 for the form, fill and seal process described above in conjunction with FIGS. 3*a–d*. The zipper arrangement 14 with spaced sliders 12 simply unwinds from the roll 80 feeding into the form, fill and seal process. FIG. 6 illustrates the zipper arrangement 14 with sliders 12 being adhered to one of the wall panels 16 of the folded web 50. The unwound zipper arrangement 14 with sliders 12 is positioned at the mouth of the web 50 between the opposing wall panels 16 and 18. As depicted in FIG. 6, the first top seal bar 56 moves back and forth to attach a portion of the zipper arrangement 14 with slider 12 to the wall panel 16 to form the first top seal 54. FIG. 6 also illustrates another embodiment for the form, fill and seal process which includes another first top seal bar 86 opposite the other first top seal bar 56. The portion of the zipper arrangement 14 with slider 12 adjacent the wall panel 16 is positioned between the two first top seal bars 56 and 86 which move back and forth to sandwich the portion of the zipper with slider 12 and the wall panel 16 between the two first top seal bars 56 and 86 to adhere the portion of the zipper 14 with slider 12 to the wall panel 16.

In an alternative embodiment for the zipper arrangement, the zipper arrangement comprises a plurality of separate zipper segments connected end to end forming the zipper arrangement with sliders as depicted in FIG. 4. Each zipper includes the male track with male profile, female track with female profile, and the slider. Each zipper has a length approximately equal to the width of the recloseable package. The zippers are preferably joined together at the notch 63 by any appropriate means such as but not limited to releasably adhesives or seals and non-releasably adhesives or seals.

Figure 7:
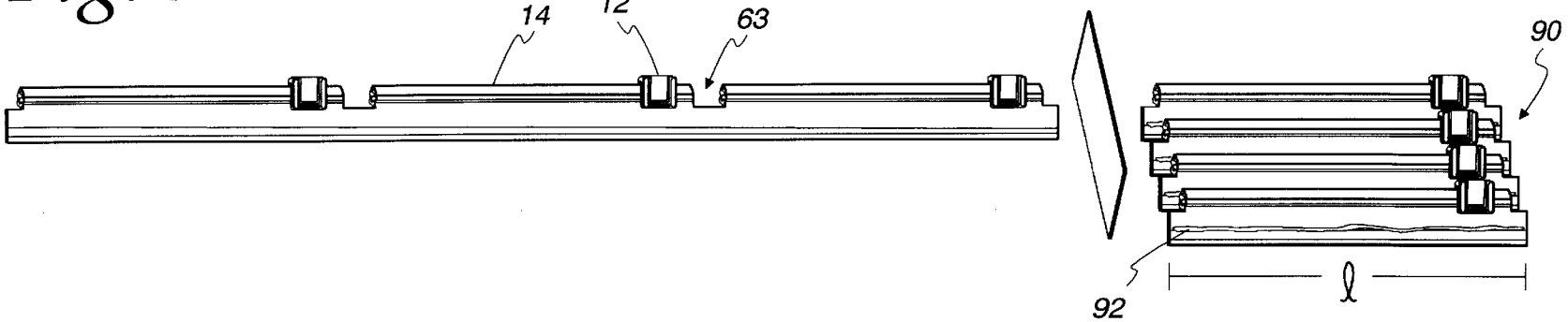
FIG. 7 is a process diagram for forming a sheet of fasteners.
Figure 8A:
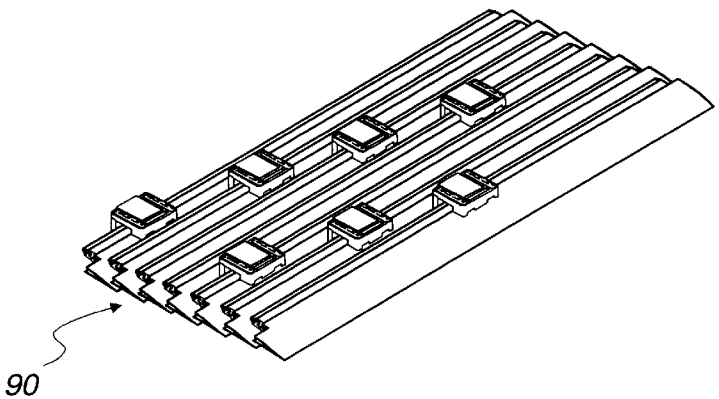
FIG. 8*a* is a perspective view of a sheet of fasteners.
Figure 8B:
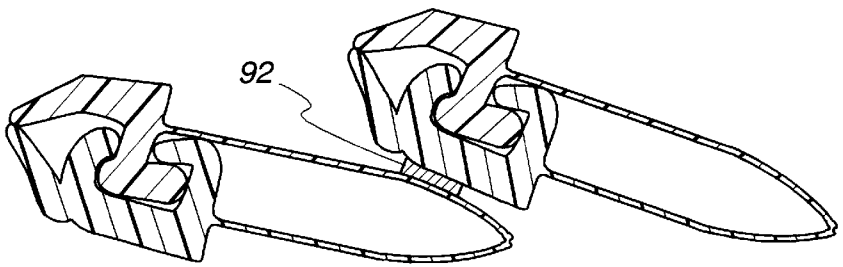
FIG. 8*b* is a cross section of two fasteners releasably adhered together of FIG. 8*a;*
Figure 9:
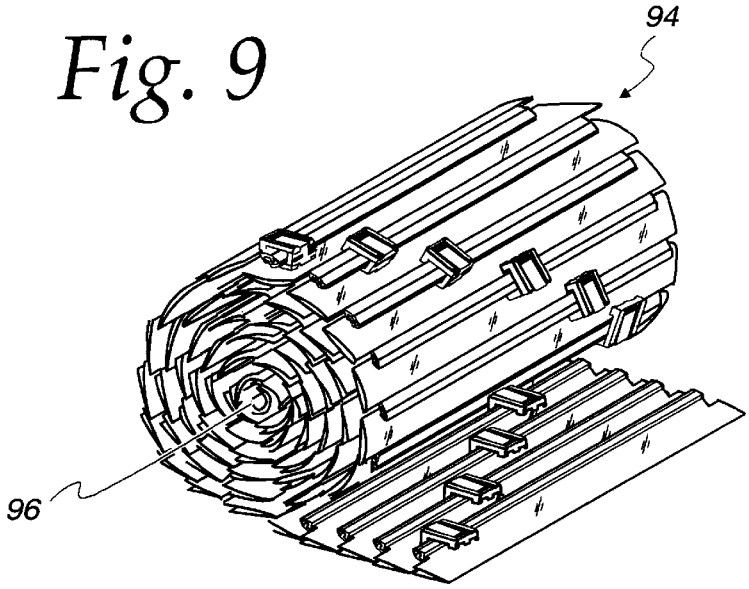
FIG. 9 is a roll of the sheet of fasteners of FIG. 8*a*.

FIGS. 7–9 illustrate another embodiment for providing fasteners 14 with sliders 12 to the form, fill and seal process illustrated in FIGS. 3*a–d*. FIG. 7 illustrates a zipper arrangement 14 with sliders 12 slidably mounted at regular intervals, such as described in conjunction with FIG. 4. The intervals between the center of one slider to the center of an adjacent slider is approximately equal to the distance between the centers of adjacent side seals 60 to insure that each package includes the slider 12.

As depicted in FIG. 7, a knife 88 cuts the zipper arrangement 14 with sliders 12 into individual lengths l. The individual lengths l are slightly larger than the width of the recloseable package, or in other words, substantially equal to the distance between the centers of adjacent side seals 60 to insure that each package includes the fastener. For the embodiment depicted, the notches are appropriately spaced for the knife 88 to make the cut at the notch 63.

FIG. 8*a* also depicts the individual lengths 1 of fasteners 14 with sliders 12 accumulated into a sheet 90. To accumulate the length of fastener 14 with slider 12, the fin 28 or 34 of one fastener 14 is releasably adhered to the profile 32 or 26 of an adjacent fastener 14 with slider 12. The fasteners are preferably positioned parallel to each other on the sheet 90. In one embodiment shown in FIG. 8*b*, a releasable adhesive 92 releasably adheres the adjacent fasteners 14 with sliders 12 to one another. In another embodiment, the profile 26 or 32 of one fasteners 14 with slider 12 is releasably sealed to the fin 34 or 28 of the adjacent fastener 14 with slider 12. The adjacent fasteners 14 of the sheet may be releasably adhered to each other by any appropriate means.

FIG. 9 illustrates the sheet 90 of the fasteners 14 with slider 12 wrapped into a roll 94 around a cylindrical core 96 or about itself to form a cylinder. The sheet 90 is preferably wrapped into a roll such that the parallel fasteners are parallel to the longitudinal axis of the cylinder. Alternating the location of the slider 12 on fastener 14 optimizes the number of wrapping on the cylindrical core 96 by preventing the sliders of adjacent layers from abutting or laying on top of each other. Additionally as depicted in FIG. 8*a*, the location of the slider 12 on its length of zipper 14 may be alternated on the sheet 90 in order to allow multiple sheets to be stacked on top of each other such that the stacked sheets 90 occupy as small a space as possible.

Figure 10:
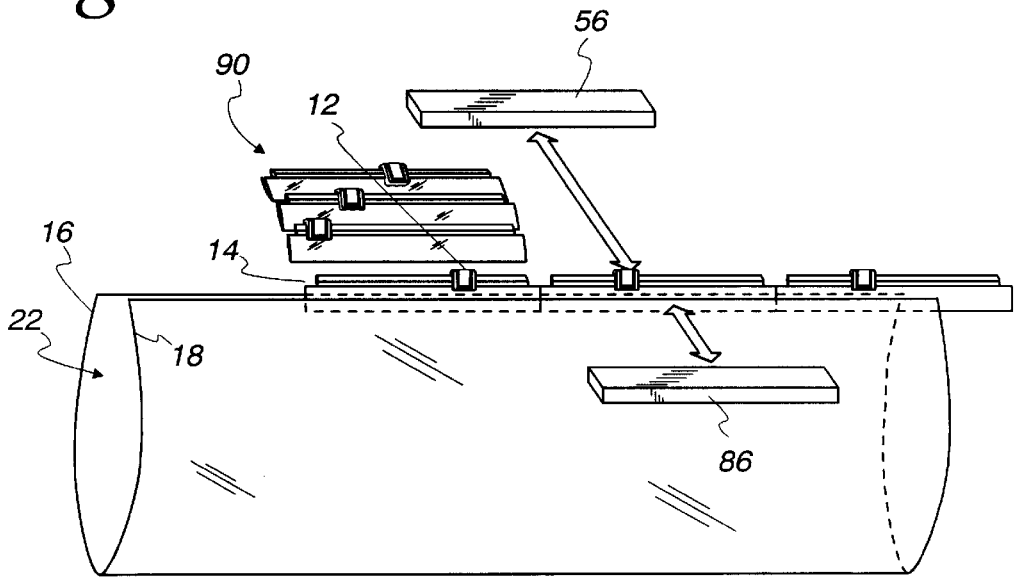
FIG. 10 is a process diagram of the sheet of fasteners of FIG. 8*a* fed to the form, fill and seal process.

The roll 94 or individual sheets 90 of lengths of zipper 14 with slider 12 is particularly useful for feeding the fastener 14 with slider 12 for the form, fill and seal process described above in conjunction with FIGS. 3*a–d*. The fastener 14 with slider 12 may simply unwind from the roll 94 as the sheet 90 for the form, fill and seal process. FIG. 10 illustrates the sheet 90 of fasteners 14 with sliders 12 feeding the form, fill and seal process. One individual fastener 14 with slider 12 is removed from the sheet 90 and placed either pneumatically, mechanically or electro-mechanically between the wall panels 16 and 18 at the mouth of the web 50. As shown in FIG. 10, the fastener 14 with slider 12 is positioned between the two first top seal bars 56 and 86 which move back and forth to sandwich the fastener 14 and the wall panel 16 between the two first top seal bars 56 and 86 to adhere the fastener 14 with slider 12 to the wall panel 16. This adhering of the fastener 14 with slider 12 repeats with the next fastener 14 with slider 12 detaining from the sheet 90 and being positioned at the mouth of the web 50. The next fastener 14 with slider 12 is preferably positioned immediately behind the last adhered fastener.

In another embodiment, the sheet of fasteners 90 may be formed and used in a slightly different manner than illustrated in FIGS. 7–10. In another embodiment, the knife 88 may make cuts to remove the notch 63 from the fastener 14. For this embodiment, the length of the fastener may be approximately equal to the width of the recloseable package. These fasteners may be fed to the form, fill and seal process as described above in conjunction with FIG. 10.

Although the zipper arrangement and sheet of fasteners has been described for use with the form, fill and seal process, the zipper arrangement and sheet of fasteners may be used in any recloseable packaging manufacturing process.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A fastener arrangement for use in manufacturing recloseable bags comprising:

a first fastener;

a second fastener connected to said first fastener, each of said fasteners comprising a male track with a male profile and a female track with a female profile, said male and female profiles being releasably engageable to each other; and a slider slidably mounted to each of said fasteners for movement between a closed position and an open position, said male and female profiles being engaged to each other while said slider is in said closed position, said male and female profiles being disengaged from each other in response to movement of said slider from said closed position to said open position, wherein said first fastener is releasably connected in line with said second fastener to form a continuous male track and a continuous female track.

2. The fastener arrangement of claim 1 wherein said first and said second fasteners are wrapped about a roll.

3. The fastener arrangement of claim 1 wherein said first fastener and said second fastener each have a length approximately equal to a width of said recloseable bag.

4. The fastener arrangement of claim 1 wherein said first fastener is releasably adhered to said second fastener, said male and female tracks of said first fastener being substantially parallel to said male and female tracks of said second fastener.

5. The fastener arrangement of claim 4 wherein said first fastener and said second fastener are rolled into a cylinder having a longitudinal axis, said male and female tracks of said first and said second fasteners being substantially parallel to said longitudinal axis.

6. The fastener arrangement of claim 4 wherein said first fastener is releasably adhered to said second fastener by a releasable adhesive.

7. The fastener arrangement of claim 4 wherein said first fastener is releasably adhered to said second fastener by a releasable seal.

8. A fastener arrangement for use in manufacturing recloseable bags comprising:

a first fastener;

a second fastener connected to said first fastener, each of said fasteners comprising a male track with a male profile and a female track with a female profile, said male and female profiles being releasably engageable to each other; wherein each of said fasteners further comprises a first fin extending downward from said male profile and a second fin extending downward from said female profile, said first fastener releasably connected in line with said second fastener to form a continuous first fin and a continuous second fin; and a slider slidably mounted to each of said fasteners for movement between a closed position and an open position, said male and female profiles being engaged to each other while said slider is in said closed position, said male and female profiles being disengaged from each other in response to movement of said slider from said closed position to said open position.

9. A fastener arrangement for use in manufacturing recloseable bags comprising:

a first fastener;

a second fastener connected to said first fastener, each of said fasteners comprising a male track with a male profile and a female track with a female profile, said male and female profiles being releasably engageable to each other; wherein each of said fasteners further comprises a first fin extending downward from said male profile and a second fin extending downward from said female profile, said first fastener connected in line with said second fastener to form a continuous first fin and a continuous second fin, wherein said continuous first fin and said continuous second fin are joined to each other along a one-time breakable preferential area of weakness; and a slider slidably mounted to each of said fasteners for movement between a closed position and an open position, said male and female profiles being engaged to each other while said slider is in said closed position, said male and female profiles being disengaged from each other in response to movement of said slider from said closed position to said open position.

10. A fastener arrangement for use in manufacturing recloseable bags comprising:

a first fastener;

a second fastener connected to said first fastener, each of said fasteners comprising a male track with a male profile and a female track with a female profile, said male and female profiles being releasably engageable to each other; wherein each of said fasteners further comprise a first fin extending downward from said male profile and a second fin extending downward from said female profile, one of said fins of said first fastener being releasably adhered to one of said profiles of said second fastener; and a slider slidably mounted to each of said fasteners for movement between a closed position and an open position, said male and female profiles being engaged to each other while said slider is in said closed position, said male and female profiles being disengaged from each other in response to movement of said slider from said closed position to said open position.

11. A fastener arrangement for use in manufacturing recloseable bags comprising:

a first fastener;

a second fastener connected to said first fastener, each of said fasteners comprising a male track with a male profile and a female track with a female profile, said male and female profiles being releasably engageable to each other; wherein each of said fasteners further comprises a first fin extending downward from said male profile and a second fin extending downward from said female profile, one of said fins of said first fastener being releasably adhered to one of said profiles of said second fastener, wherein said first fin and said second fin are joined to each other along a one-time breakable preferential area of weakness; and a slider slidably mounted to each of said fasteners for movement between a closed position and an open position, said male and female profiles being engaged to each other while said slider is in said closed position, said male and female profiles being disengaged from each other in response to movement of said slider from said closed position to said open position.

12. A sheet of zippers for use in manufacturing recloseable packages, said sheet of zippers comprising:

a first zipper comprising a first male track with a first male profile and a first female track with a first female profile, said first male and first female profiles being releasably engageable to each other;

a first slider slidably mounted to said first zipper for movement between a closed position and an open position, said first male and first female profiles being engaged to each other while said first slider is in said closed position, said first male and first female profiles being disengaged from each other in response to movement of said first slider from said closed position to said open position;

a second zipper comprising a second male track with a second male profile and a second female track with a second female profile, said second male and second female profiles being releasably engageable to each other; and a second slider slidably mounted to said second zipper for movement between a closed position and an open position, said second male and second female profiles being engaged to each other while said second slider is in said closed position, said second male and second female profiles being disengaged from each other in response to movement of said second slider from said closed position to said open position, said second zipper being releasably connected to said first zipper;

wherein said first zipper is releasably adhered tos aid second zipper by a releasable seal; and said first male and female tracks of said first zipper are substantially parallel to said second male and female tracks of said second zipper.

13. The sheet of claim 12 wherein said first zipper and said second zipper each have a length approximately equal to a width of said recloseable package.

14. The sheet of claim 12 wherein said first zipper is releasably adhered to said second zipper by a releasable adhesive.

15. The sheet of claim 12 wherein said first zipper is releasably adhered to said second zipper by a releasable seal.

16. The sheet of claim 12 wherein said first male and female tracks of said first zipper are substantially parallel to said second male and female tracks of said second zipper.

17. The sheet of claim 16 wherein said sheet is wrapped about a roll having a longitudinal axis, said first and said second male and female tracks are substantially parallel to said longitudinal axis.

18. The sheet of claim 12 second fastener are rolled into a cylinder having a longitudinal axis, said male and female tracks of said first and said second zippers are substantially parallel to said longitudinal axis.

19. The fastener arrangement of claim 18, wherein said fastener segments are connected in line with each other to form a chain.

20. The fastener arrangment of claim 18, wherein said fastener segments are releasably adhered to each other to form a sheet of said fastener segments.

* * * * *

UNITED STATES PATENT AND TRADEMARK OFFICE

CERTIFICATE OF CORRECTION

PATENT NO. : 6,327,754 B1
DATED : December 11, 2001
INVENTOR(S) : Belmont et al.

It is certified that error appears in the above-identified patent and that said Letters Patent is hereby corrected as shown below:

Column 11,
Line 8, change "tos aid" to -- to said --.

Signed and Sealed this

Twenty-fifth Day of April, 2006

JON W. DUDAS
*Director of the United States Patent and Trademark Office*